US006359839B1

(12) United States Patent
Schenk et al.

(10) Patent No.: US 6,359,839 B1
(45) Date of Patent: Mar. 19, 2002

(54) WATCH WITH A 24-HOUR WATCH FACE

(76) Inventors: Thomas C. Schenk, Liniengasse 16/16, A-1060 Wien (AT); Martin U. Schenk, Grabenstrasse 45/55, A-8010 Graz (AT); Johanna Schenk, Anton Andererplatz 2/2, A-1210 Wien (AT)

( * ) Notice: Subject to any disclaimer, the term of this patent is extended or adjusted under 35 U.S.C. 154(b) by 0 days.

(21) Appl. No.: 09/582,304

(22) PCT Filed: Dec. 8, 1998

(86) PCT No.: PCT/EP98/07950

§ 371 Date: Aug. 14, 2000

§ 102(e) Date: Aug. 14, 2000

(87) PCT Pub. No.: WO99/34265

PCT Pub. Date: Jul. 8, 1999

(30) Foreign Application Priority Data

Dec. 23, 1997 (DE) ..... 197 57 722
Jun. 10, 1998 (DE) ..... 198 26 017

(51) Int. Cl.[7] ..... G04B 19/26; G04B 19/24; G04B 19/04

(52) U.S. Cl. ..... 368/16; 368/28; 368/80; 368/223

(58) Field of Search ..... 368/15–19, 28, 368/37, 74, 80, 82, 223

(56) References Cited

U.S. PATENT DOCUMENTS 3,982,104 A 9/1976 Banner
5,283,769 A 2/1994 Renton

FOREIGN PATENT DOCUMENTS

| | | |
|---|---|---|
| CH | 664 468 | 3/1988 |
| CH | 671 317 | 8/1989 |
| CH | 687 494 | 12/1996 |
| DE | 42 26 448 | 4/1993 |
| DE | 195 00 414 | 3/1997 |
| EP | 0 655 665 | 5/1995 |
| GB | 2 304 426 | 3/1997 |

OTHER PUBLICATIONS

Patent Abstracts of Japan, vol. 017, No. 070 (P–1485), Feb. 12, 1993 & JP 04 276590 A (Casio Comput Co Ltd), Oct. 1, 1992, see abstract.

*Primary Examiner*—Vit Miska
(74) *Attorney, Agent, or Firm*—Pearne & Gordon LLP

(57) ABSTRACT

A watch having a watch face comprising an analog 12-hour display which displays a 24-hour day in an ambiguous manner using an hour hand and a minute hand, and an additional display which is used to determine the time indicated by the hour and minute hands and has two distinguishable symbols which are visible in said additional display separately from each other and change approximately every 12 hours. The invention is characterized in that the distinguishable symbols are configured as day and night symbols in such a way that they can be unambiguously interpreted as such by anyone and that the change-over from the night symbol to the day symbol occurs at 6 a.m. and the change-over from the day symbol to the night symbol at 6 p.m. either suddenly and precise to the second or over a period of time which can be observed dynamically so that there is never any doubt as to the time being shown.

12 Claims, 7 Drawing Sheets

Figure 1:
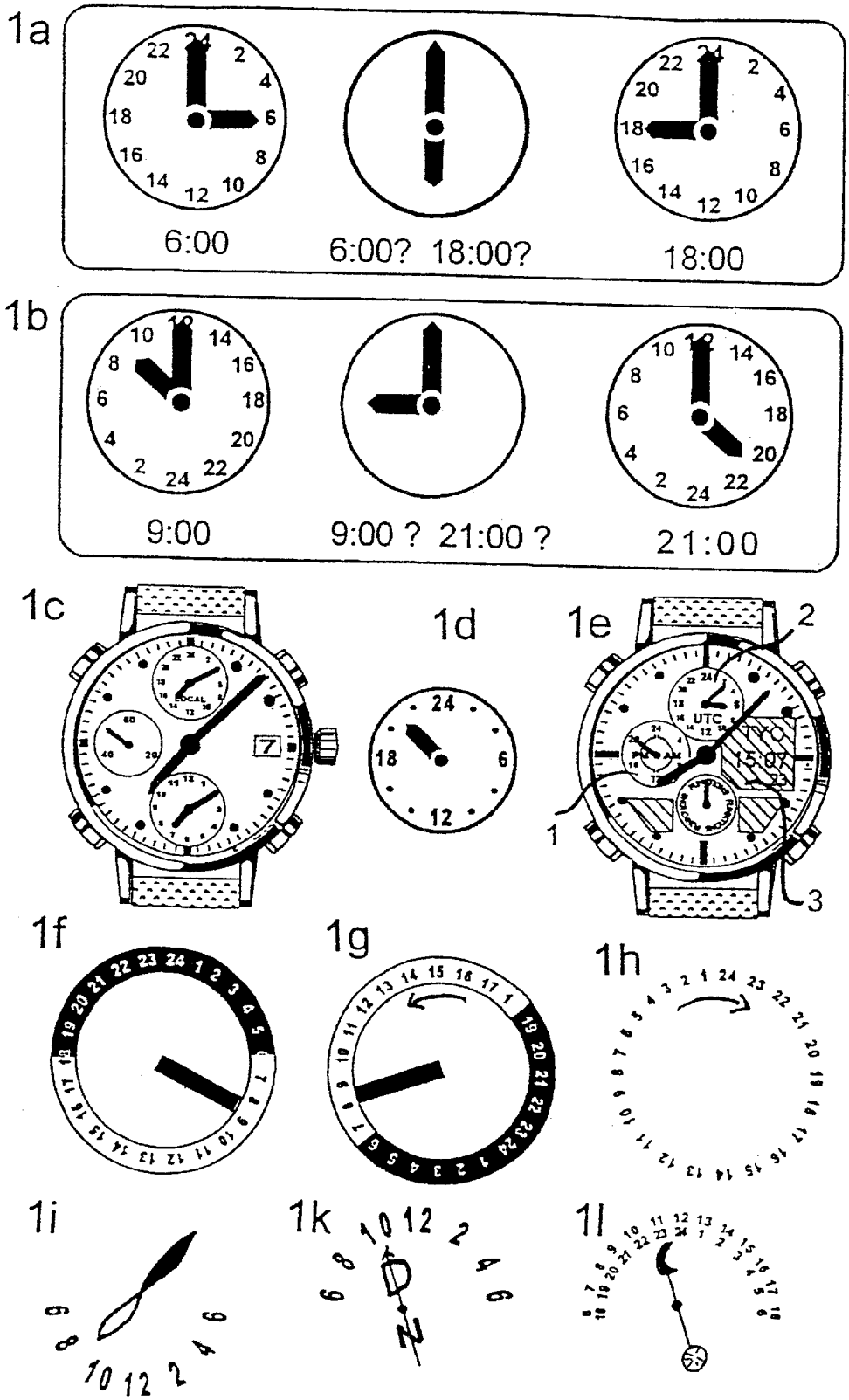

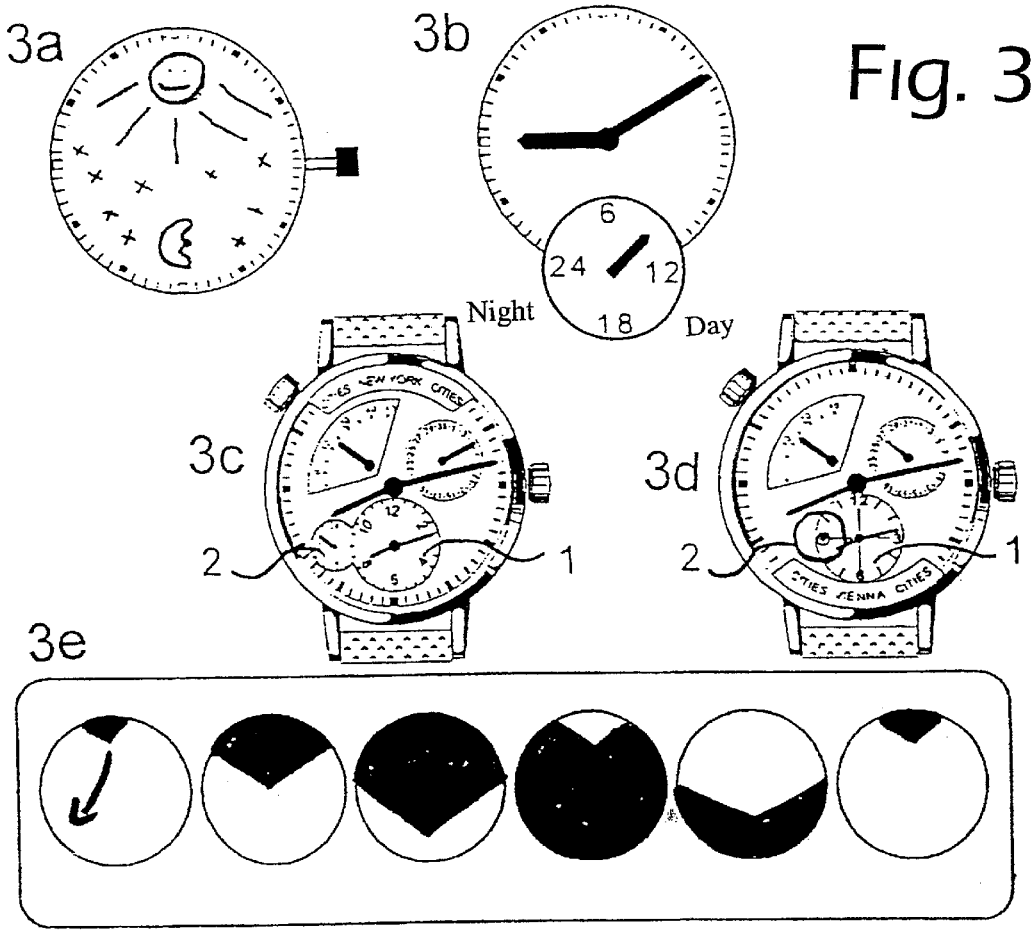
Fig. 3
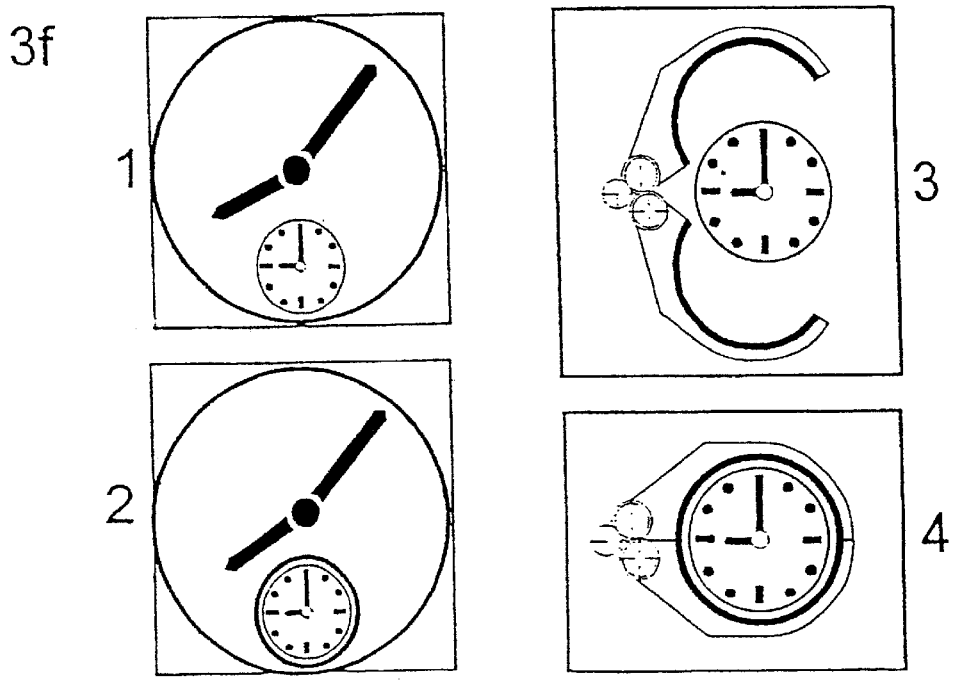

4a

4b

4c

5a

5b

5c

7a

7b

7c

WATCH WITH A 24-HOUR WATCH FACE

FIELD OF TECHNOLOGY

The invention refers to a watch/clock with a dial consisting of an analog 12-hour display that ambiguously represents a 24-hour day using an hour and minute hand and an additional display that serves to specify the time shown by the hour and minute hands, displaying two distinguishable symbols that are visible separately from one another in the additional display and which alternate at intervals of roughly 12 hours.

STATE OF THE ART

In order to present the problem associated with the analog dials described above, namely an ambiguous display of the time, known watch/clocks are to be described using FIGS. 1 to 5. FIG. 1*a* shows in the middle the ambiguous half-day dial showing 6.00 or 18.00. Anyone who can read this normal dial is accustomed to being able to read one of the two possible times from the position of the minute and hour hands. With the analog ambiguous half-day dial, which very frequently also contains digits but mostly only dots and lines, we actually only read angles to know what time it is. Objectively, the time cannot, however, be determined exactly if only the information is used that can be read from the watch/clock. Without knowing whether it is evening or morning, the mere information of the position of the hands in the middle illustration of the watch/clock does not permit an unambiguous statement of the time.

The situation is very different, however, for instance with one of the many analog 24-hour auxiliary dials. To the left and right of the half-day dial in FIG. 1*a,* the time 6.00 or 18.00 is shown on a very frequently used dial on which 12.00 midnight is at the zenith, 12.00 midday at the place where we otherwise expect 6.00 or 18.00. This example clearly shows how alien this presentation of 6.00 and 18.00 is.

FIG. 1*b,* Here, too, the ambiguous half-day dial is shown in the middle with a typical angle that clearly and rapidly tells us that it can only be 9.00 or 21.00.

On both sides of this dial is a likewise very frequent alternative of the 24-hour dial, where the zenith shows 12.00 midday and the bottom 12.00 midnight. The inventor of this rarely used dial perhaps felt that we tend to expect the sun at 12.00 midday at the zenith. Nevertheless, the display of the times 9.00 and 12.00 midday is just as confusing and cannot be read without figures.

FIG. 1*c* shows an analog watch with three analog time displays. At first sight, it could be assumed that all three dials are showing 7.07 or 19.07. Far from it. Only two of them, the main dial and that in the lower half, are the familiar ambiguous half-day dials, while the upper shows local time as 16.07, which can only be identified, however, on close examination.

FIG. 1*d* is a common 24-hour auxiliary display with an hour hand. This auxiliary display is only used in combination with an ambiguous halfway dial in order to render the latter unambiguous. The hour hand here points to 21.00.

FIG. 1*e* is a likewise common wristwatch showing three different times. In this case, all three times must be represented in completely different, i.e. difficult to identify, ways. The analog main display on the ambiguous half-day dial points to 8.07 or 20.07 p.m. In a 24-hour auxiliary display, 1, this ambiguity is removed since the hour hand in this display is pointing to around 20.00. In order to be able to perceive this more quickly, since the position of the hand pointing to 20.00 is very alien to us, two additional half-day rings for p.m. and am. are present The a.m. and p.m. zones are, however, completely alien to us Europeans. A 24-hour display, 2, similar to FIG. 1*a,* is located in the upper part of the main dial. On the right-hand side of the main dial, 3, a second local time is provided in digital representation. In order to represent three different times, four different presentation methods are necessary here. Curiously, only the two digital presentations permit a rapid perception or comparison of the times and the determination of where it is now day or night, but these as a matter of principle cannot be read quickly.

FIGS. 1*f* and 1*g* are representations of time with a dial turning to the right, in which the light side shows daytime and the dark side very graphically shows night-time. The fact, however, that the dial turns means that the representation of 8.30 cannot be perceived automatically and at a glance.

FIG. 1*h* shows a 24-hour circle that turns clockwise once a day as a means of indicating local time, and is used with a revolving lunette or as a fixed point on a wristwatch/clock.

FIG. 1*i* shows another alternative that represents daytime or night time using a propeller-like hour hand. This blade turns once on its axis every 24 hours, the light hand showing daytime and the dark hand night-time on a half-day scale.

FIG. 1*k* is a halfway display similar to FIG. 1*i,* in which an hour hand with two pointers turns. On the one side N stands for night-time on the other side D stands for day.

FIG. 1*l* is a time representation with two half-day rings. On the outer ring, the day hours from 6.00 to 18.00 are written, while the inner ring bears the night times from 18.00 to 6.00 in the morning. A 24-hour hand with on the one side a moon and on the other side a sun shows which hour of the day or night it is.

FIG. 2*a* shows a display as used for heating systems. The sun and the moon are both represented on dark fields. It is not possible to distingush rapidly which is daytime and which is night-time.

FIG. 2*b* shows an alternative of the 24-hour auxiliary display shown in FIG. 1*d.* This hour display is alien to us, but is somewhat more easily perceived by virtue of the fact that night-time from 18.00 to 6.00 in the morning is shown in dark colour, daytime in light colour.

FIG. 2*c* shows, however, another 24-hour wrong-angle display that is used, in which strangely night time is shown light while daytime is somewhat darker. Such a display confuses the unfamiliar user.

FIG. 2*d* shows another 24-hour wrong-angle auxiliary display of a very well known wristwatch/clock. The dark shade shows the p.m. time, the light the a.m. time, with the result that it is no longer possible to conclude what is day or night.

FIG. 2*e* is an auxiliary display for a wristwatch with dark for a.m. and light for p.m. As in many other watches/clocks, a 24-hour disc turns behind the circular small window to the right. In this representation, it is approximately midnight. The small window goes dark in the first hours of the morning and slowly light from 12.00 midday.

FIG. 2*f* represents one of 6 local time clocks sold as a unit for various world times. The local time on the ambiguous halfway dial is supplemented here, too, by an a.m.–p.m. auxiliary display (2*f*1). However, in this display, a.m. is shown light and p.m. dark. Here, too, there is a gradual transition and for this reason the time is not easy to identity.

In a new time management programme, small analog time displays are presented alongside the digital times in order to permit a more rapid perception of the time (see FIG. 2*g*). In order to counterbalance the ambiguity of our normal dial, the a.m. time is represented with a light coloured clock, the p.m. time with a dark clock. Strangely, from midnight on, the night hours appear light, will the day hours from 12.00 are dark!

FIG. 2*h:* in the battle for customers, the simple and clear representation of shop-opening hours plays a major role. This is a successful attempt to eliminate all uncertainties from the ambiguous half-day dial. This type of representation has the advantage over all the others that it can be perceived very quickly.

FIG. 2*i* merely presents an overview of the positions at which auxiliary windows are usually located on the dial: 1 is the auxiliary window discussed under FIG. 2*e*. In this case, the change is from top to bottom. 2 shows the day/night auxiliary window of a 24-hour alarm clock. The change from day to night is gradual, and from right to left. 3 is an a.m.–p.m. window of a well known wristwatch, shown under 2*m*. 4 is a day/night window of a wristwatch where the transition from one period of time to the other likewise takes place vertically but from left to right. The uncertainty that this window creates in the transitional time depends on its size. However, in no case is the display unambiguous, since the change takes place gradually and very slowly without any movement being perceptible towards light or dark, thus making the time specification ambiguous.

FIG. 2*k* represents a wristwatch/clock with two day/night auxiliary windows 1 and 2. The first auxiliary window explains the main display. The second auxiliary window explains a second hour hand 3, which can be used to represent a second time. This second time can be perceived very well, since it is presented in normal 12-hour manner. However, a great disadvantage is the ambiguity over a relatively long period of time, since here, too, the transition from day to night takes place gradually as described under FIG. 2*l*.

FIG. 2*l* shows the change of the day/night window in FIG. 2*k*. In FIG. 2*l,* illustrations 1 to 3 show darkening from bottom left upwards, whilst illustrations 4, 5 and 6 show darkening by means of a rightward movement from bottom right upwards.

Figure 2:
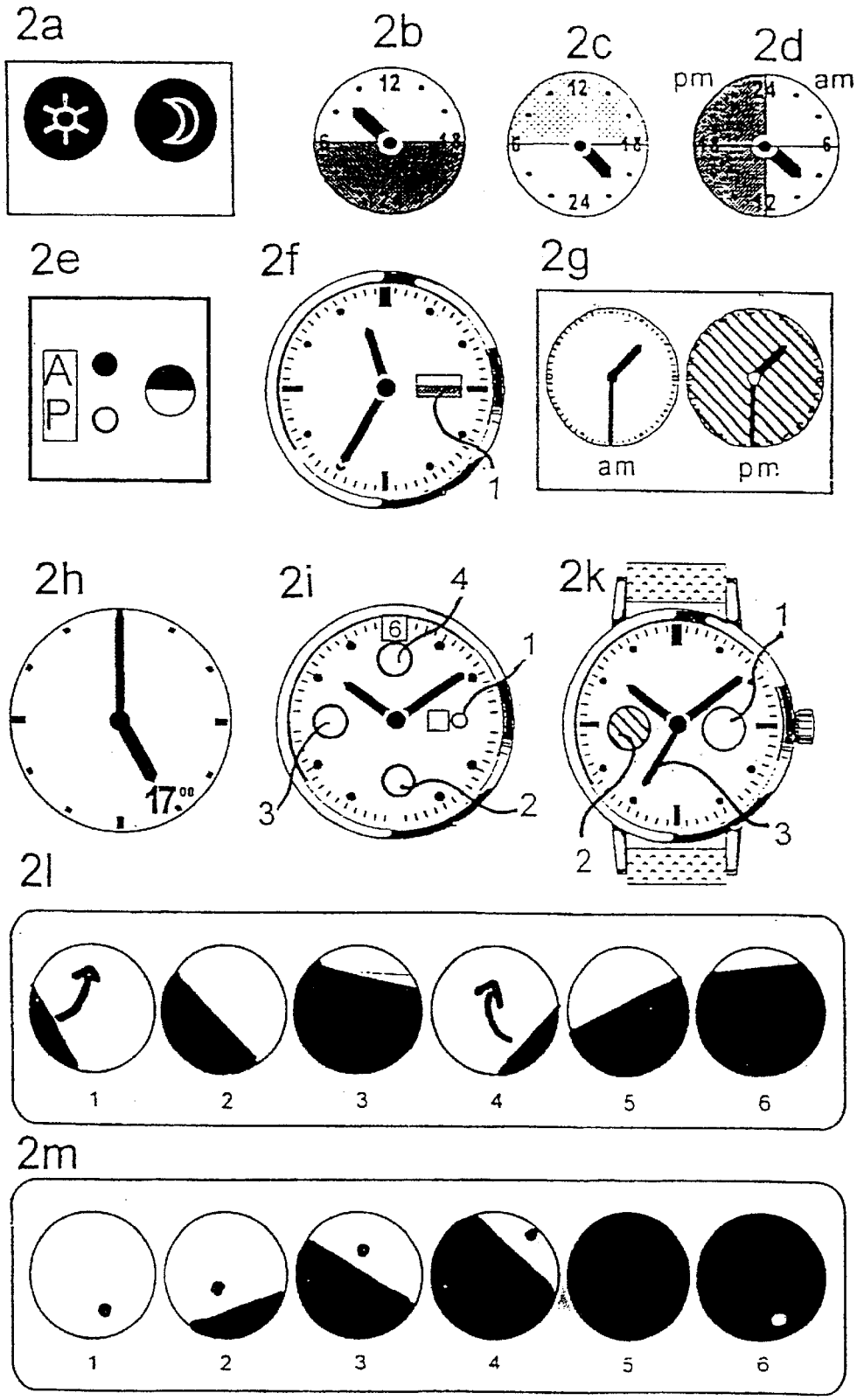

FIG. 2*m:* illustrations 1 to 6 show the change of the day and night window in the case of a wristwatch in a window mentioned under 2*i*3. The 2-time zone is shown on this watch with a white hand on a 24-hour scale on the edge of the dial. The change in the day/night window first takes place with a dot that comes into the window from bottom right and then—see FIGS. 2*m*2 and 2*m*3—is followed by an area which turns clockwise until the window is completely dark after about 4 hours.

FIG. 3*a* shows the sun and moon disc of a watch where the main dial has a larger window at the 12.00 position. The background is not, as in the drawing, light, but instead the sun and the moon and their rays and stars stand against a blue sky, making the transition from day to night difficult to see—and unuambigiity is only the case when the sun or the moon is fill. With this day/night display, neither the symbols nor the colours show the exact point of change.

FIG. 3*b* shows the dial of a watch with the half-day main dial supplemented by a 24-hour display, which unlike all other 24-hour displays shows midnight, 24.00, to the left (at 9.00), 6.00 in the morning at the top (at 12.00) etc. In this way, night-time is shown in the left half of the additional display, daytime in the night half In addition the word "Night" is on the left and "Day" is on the right, so that the global traveller never confuses day and night.

3*c* shows a wristwatch with an analog half-day local time display (3*c*1) and an original 24-hour additional display (FIG. 3*c*2). Both displays overlap, with the result that the fact that they belong together is unambiguous, and readability is also relatively good. FIG. 3*d* is practically a further development of FIG. 3*c*. The analog local time (3*d*1) with half-day dial is supplemented by a day/night window (FIG. 3*d*2) through which part of a rotating 24-hour disc underneath can be seen (see FIG. 3*e*).

FIG. 3*e* shows the change of the window of FIG. 3*d*2. Although the fact that the window belongs to the half-day dial is very well solved, and also that the display is very good at fill day or full night, the area of doubt in the transitional period from light to dark or dark to light applies for a very long time and is thus unsuitable for a general, unambiguous and doubt-free 24-hour display.

FIG. 3*f* shows a 24-hour display on which the right time of the day can be read at every second since the change from one half-day to the other is not gradual, as with all the other systems, but takes place precisely to the second. This is German patent "Watch/clock with dynamic target time representation" (P 42 26 448).

Figure 4:
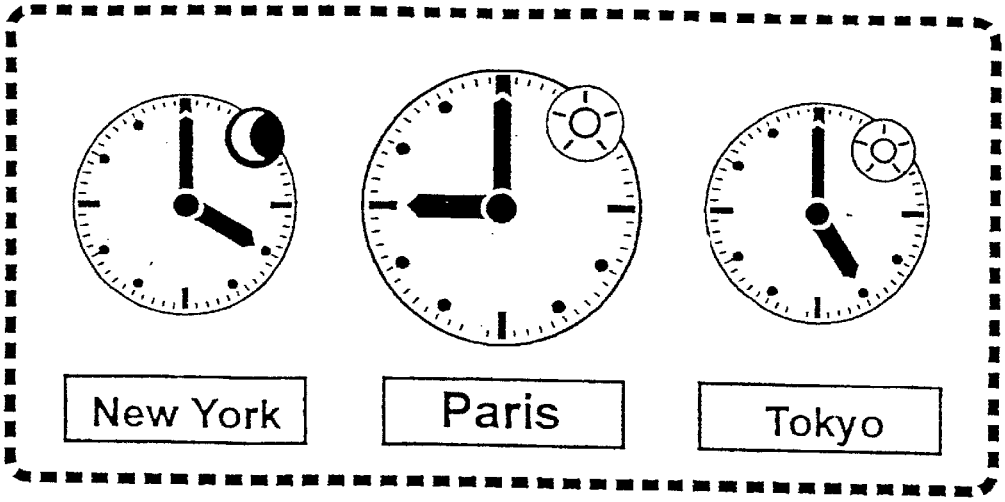
Figure 4:
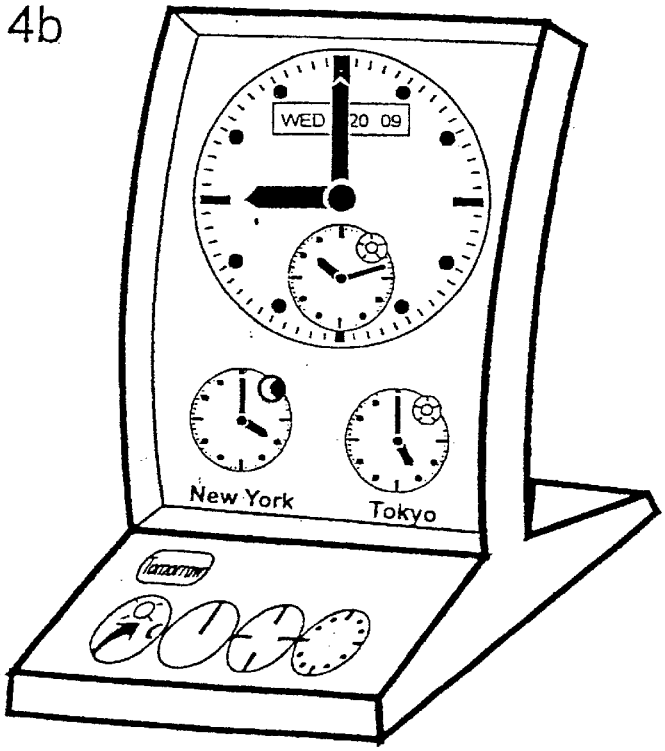
Figure 4:
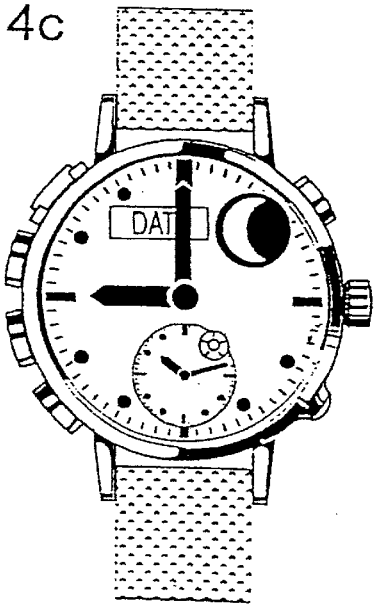

FIG. 3*f*1 shows an analog watch/clock with the date in the upper half and an appointment trailer watch/clock in the lower half In FIG. 3*f*2, the appointment trailer watch/clock reveals another characteristic, a ring, which may also be in colour. This ring means that the time represented is in the second half of the day. In this way it would show unambiguously that the time in FIG. 3*f*1 is in the morning, while the time in FIG. 3*f*2 refers to the evening. The ring, which turns around the watch/clock, is achieved by means of a mechanical device as shown in FIGS. 3*f*3 and 3*f*4. Although, compared with other systems, this represents by far the best solution, it is entirely unsuitable for a generally understandable representation of an unambiguous natural 24-hour analog watch/clock. Only the expert knows whether the watch/clock with a dark edge represents a.m. or p.m. time or possibly daytime or night-time (6.00 in the morning to 18.00 in the evening or 18.00 to 6.00).

To this must be added the fact that this ring restricts the design in substantial aspects, for dark-edged analog dials are a popular artistic element for wristwatch/clockes and clocks.

This attempt to solve the problem and represent an unambiguous generally understandable and immediately perceptible time or local time must also be regarded as unsuccessful.

In summary, it can be stated that the decades of attempts by many renowned world companies and individuals have to date not succeeded in developing simple analog time displays in conjunction with date for the representation of appointment times or to represent local times, e.g. in connection with towns, for which there is huge demand as a result of globalisation.

All previous attempts, either by using the 24-hour dial or the auxiliary displays, do not provide an even approximately satisfactory solution, Neither the colour nor the light or dark fields nor the movements of direction, whether from left to right top to bottom, show any logical relationship with time. To this must be added the fact that, with the exception of the last example (FIG. 3*f*), the transition from one half of the day to another is always represented gradually, with a static effect such that no movement can be perceived, such that the time display cannot be accurately perceived, often for many hours. Thus the day or night symbols and even illustrations of the moon or the sun have to date not achieved a solution to the problem.

However, using the means of distinction only unsatisfactorily solved above to determine whether it is day or night, it is nevertheless possible to suggest a possibility of entering date-specified appointments as target times in the watch/clock.

If one wishes to set more distant times on analog clocks or watches, for instance 5 or 20 hours away from the current time, this is a problem with the current systems, since they either move very slowly or in a very confused mower towards such a time.

There are fundamentally two systems. In the first, the hands of the analog dial move towards the target minute by minute and hour by hour, show this time or, once the time has been reached, return to the present time. With usual watches, this process lasts between 15 and 30 seconds. This does not permit the rapid display of a time, and in addition, the real time within a full 24-hour day can only be represented with the assistance of a second 24-hour auxiliary display or the like.

A more rapid method, which is being used more and more, is to move the minute and hour hands separately bringing each of them to show the target time in the shortest way. It is easy to conceive how confusing this is, for often the hands turn backwards when a time is displayed that is before the present. Nor is it possible to follow this process mentally, since the movements of the hands are completely independent of the distance of the target time to be aimed at. A means to solve these problems and in order to represent large time leaps to known important starting times such as the beginning of the afternoon, evening, the beginning of the next day, the next week or the next month, will be shown here in conjunction with the new natural 24-hour dial.

REPRESENTATION OF THE INVENTION

The invention is based on the problem of creating a new 24-hour dial that permits an unambiguous presentation of the time over the entire day on the basis of our present ambiguous half-day dial, in such a way that it can be perceived unambiguously and rapidly by anyone around the globe, by young and old in any culture. This new dial is intended to permit the representation not only of world times in connection with towns such as at airports, stock exchanges, banks, travel agencies, reception halls, clocks and watches, but also permit both the representation of appointment times in connection with date and the general presentation of time during the entire day for shop-opening hours, representations of computer time or television stations. This dial is designed in such a way that it can also be combined in a variety of way, e.g. appointment times with world times, expiry times, etc.,—times that can all be represented with the same dial and hence can be rapidly compared with one another. In addition, the clock should permit the user to set target times in the future easily and visually straightforwardly using the unambiguous distinction between day and night.

The problem underlying the invention is set out in claims 1 and 13. The features forming the advantages of the invented idea are the subject matter of the dependent claims.

The invention concerns a watch/clock with a dial with an analog 12-hour display that represents a 24-hour day ambiguously using an hour and a minute hand, an additional display that serves to specify the clock time shown using the hour and minute hands, and which includes two distinguishable symbols that are visible separately from one another in the additional display and which alternate at intervals of roughly 12 hours. formed in such a way tat the two distinguishable symbols are in the form of symbols for day and for night respectively such that they can be interpreted by anyone unambiguously and such that the change from the night symbol to the day symbol at 6 o'clock in the morning or from the day symbol to the night symbol at 6 o'clock in the evening is either sudden and precise to the second, or takes place over a period of time that can be experienced dynamically such that there is unambiguity at all times with respect to the time shown. Such periods of time that can be experienced are usually of a few seconds in duration, at most 1 minute.

Consequently, a watch/clock according to the invention shows ideally the following features:

the time display has the same hands and the same numbered hour dial as today's half-day display.

Two half-days are displayed, but not 12 a.m. hours and 12 p.m. hours, but instead the natural day and night times from 6.00 in the morning to 18.00 in the evening and from 18.00 in the evening to 6.00 in the morning.

The typical symbols of sun and moon are used for day and night.

To distinguish day, a light surface with the sun and a dark surface with the moon are used. Thus day and night are immediately apparent in two ways and for everyone, whereby the colouring—even if the symbol is not unambiguously identified from a distance—, the dark or light area, has a considerable effect from a distance.

Time accuracy throughout the enter 24 hours is ensured by the fact that the symbols for day or night switch to the second, i.e. the beginning of the day is represented at 6.00 in the morning by a movement of the sun. While the beginning of the night at 18.00 by a movement of the moon.

The day or night symbol is mounted at a conspicuous position on the dial, with the result that it is possible to read the presentation of the time practically without restrictions, and in addition a wide range of possible combinations with other presentations of time can be made on the same dial.

In addition, according to the invention, the representation and setting of target times that can be entered is carried out by means of typical movements of the hands in such a way that the target time can already be characterised by the typical movement of the handing question. A user can follow the process internally, and when the target time is reached the event is displayed to him precisely via the arrival at the hand position, either through a typical position of the hand, a change of the day/night symbol or a date. In order to be able to input target times, target time keys are provided such as shown in WO 93/03428. At this point, the content of the disclosure of this publication is expressly pointed out and reference made thereto. By activating an input device once or several times, it is possible—always starting from the present time—to move directly to main times. The idea according to the invention is described here in particular with reference to the illustrations.

The invention is described using example embodiments and referring to the drawings as examples, without such amounting to a restriction of the general idea of the invention. The figures show:

FIGS. 1–3 Known dials

Figure 5:
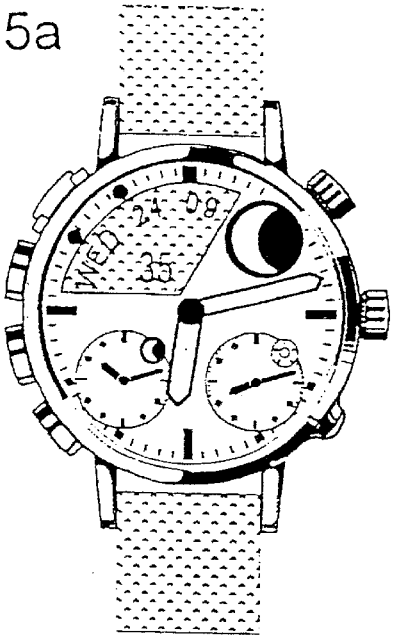
Figure 5:
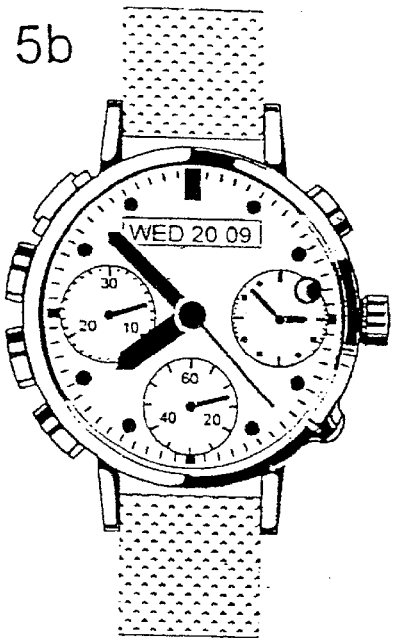
Figure 5:
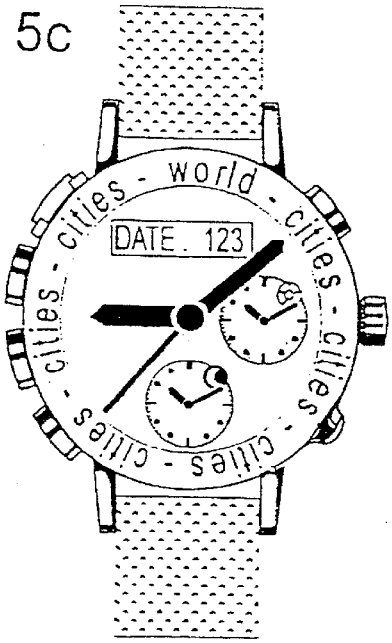

FIGS. 4–5 Dials with the additional display according to the invention

Figure 6:
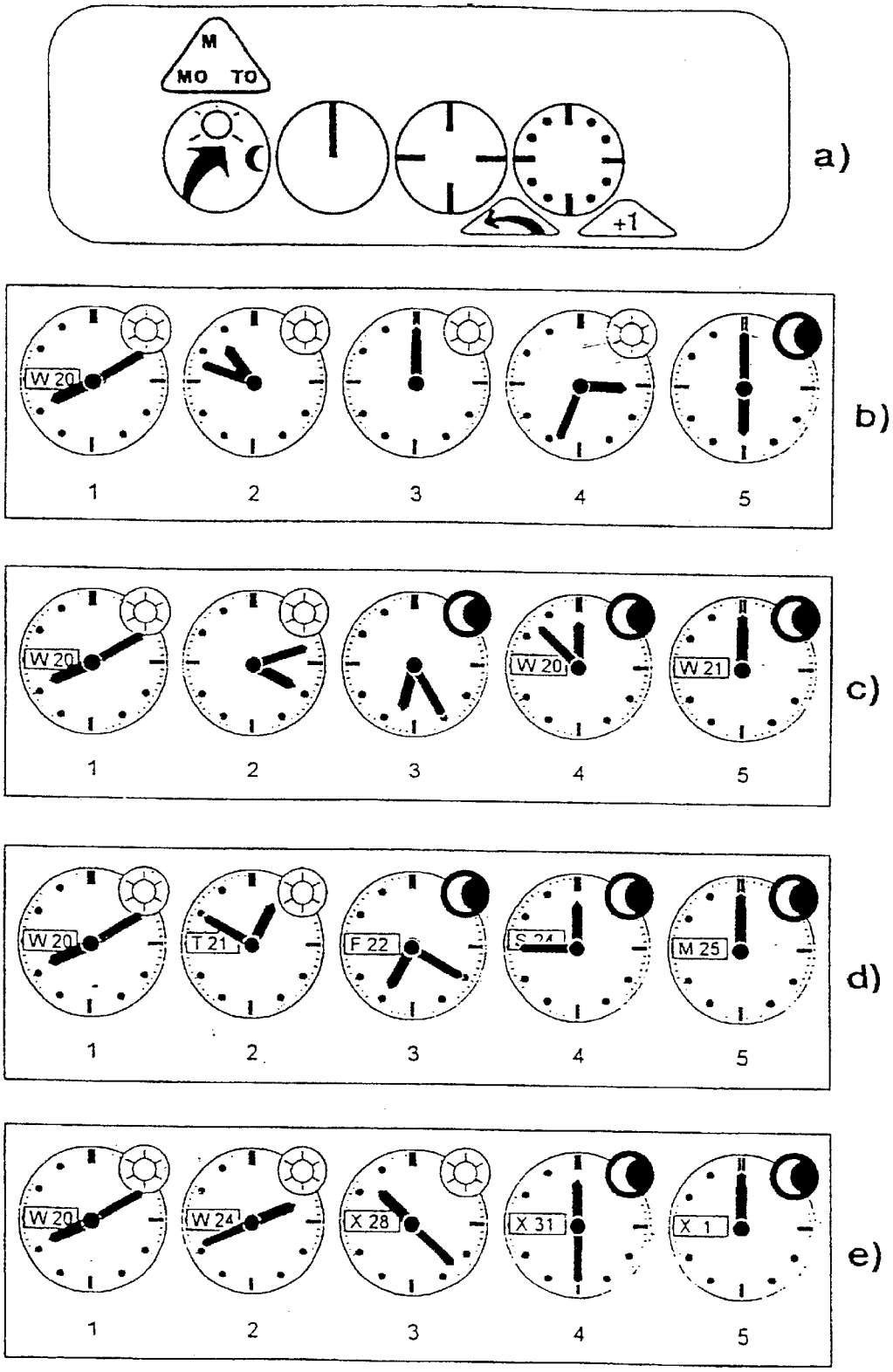
Figure 7:
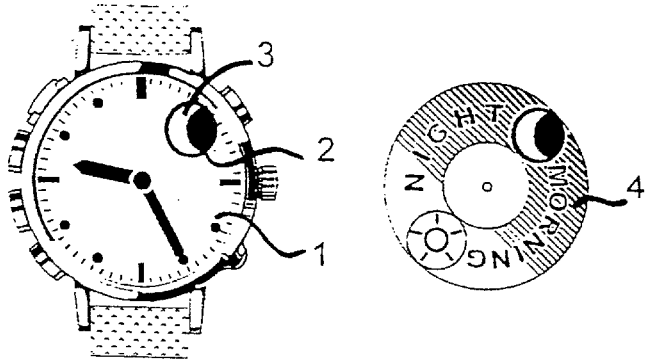
Figure 7:
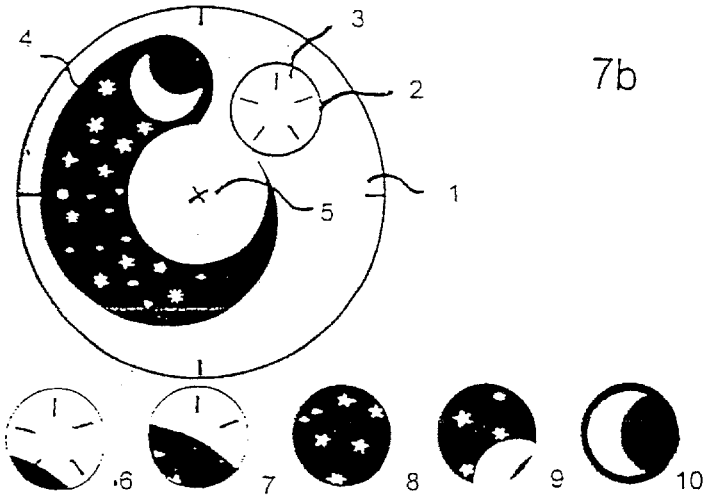
Figure 7:
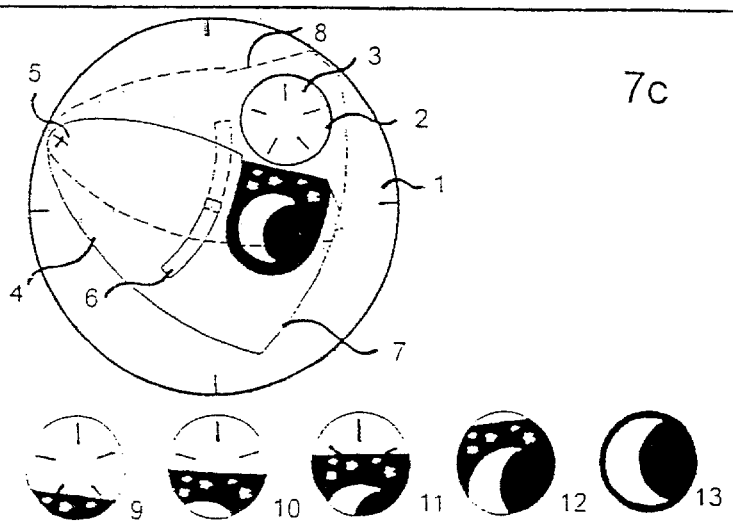

FIGS. 6 *a–e* Representation of a rapid and understandable adjustment of target times, and FIGS. 7 *a–c* The change that can be experienced dynamically between the day and night symbols.

FIG. 4*a* shows three typical world times in New York, Paris and Tokyo, which can be read easily by anyone. A characteristic of the sun and the moon in the entire dial is that the point of the limit of the sun and moon symbols normally goes precisely through the point on the dial at which otherwise the first or second hour is displayed. Thus if necessary, with an appropriate design of the hand and the sun and moon symbol, the minutes 6 to 9 could be shown on the edge of the day and night symbols, which is, however superfluous in all the models shown here.

FIG. 4*b* shows a clock with appointment time input in the pedestal according to the patent, and the appointment entered is displayed on an additional display in the main dial—here 10.13 in the morning. In addition, the clock is fitted with two world times that can be read and understood by anyone. Clocks of this kind can satisfy the huge demand for world time and appointment clocks.

FIG. 4*c* shows an astronaut's appointment watch. The main dial contains both the analog appointment display for 10.13 in the morning, and the night symbol moon on a dark area in order to show that the main display is showing 21.00 and not 9.00 in the morning.

FIG. 5*a* is again an astronaut's watch, characterised by the large night symbol in the main dial. In the same analog representation, there are two additional time displays which can be used for appointment times, local times or other purposes, and can be comprehended just as quickly. A fourth display permits the representation of additional data—including additional times, if only in digital form.

FIG. 5*b* is a combination of a chronograph with an appointment time.

FIG. 5*c* is a world time and appointment watch. On the one natural 24-hour display it is possible to show an appointment in conjunction with the date. On the second natural 24-hour dial, it is possible to show a world time, e.g. in combination with an additional hand that points to a town on the edge of the dial. Additional displays for watches/clocks, screen representations and representations of shop opening hours, television times etc. are not presented since these arc self-evident by analogy with the few examples set out here.

FIG. 6 shows four representations of how the leaps to times of the day (12.00, 18.00, 0.00, 6.00), to tomorrow, Monday or the beginning of a month are carried out. This is achieved with four elements. Firstly with separate hands with the symbols of sun and moon for day and night and with display of the date.

FIG. 6*a* shows the input elements for switching to target times starting from the present time. The round key showing the sun for 12.00 midday, the moon for 18.00 evening, permits the switch to the beginning of the main daytimes, midday, evening, night and morning. The triangular key above with the abbreviation "TO" for tomorrow, "MO" for Monday and "M" for month permits the single or repeated input of the target times tomorrow (0.00), of the next Monday (0.00) or the beginning of the next month (0.00). If for instance one wishes to move to Tuesday next week, 6.00 in the morning, one would press the Monday key (Monday 0.00), then the tomorrow key (Tuesday 0.00) then the round time-of-day key (leap from midnight to 6.00 in the morning). In order to be able to follow this process internally and to enter the time very quickly, the typical movements of the hands are explained in FIGS. 6*b* to 6*e*.

FIG. 6*b* starts from the Clock time (1) 8.10. The first target time is 12.00 (3). Instead of turning hour for hour to 12.00, the minute hand simply moves towards 12.00 and at the same time the hour hand also starts towards the same target (2). Both hands reach 12.00 at the same time. The next time of day, 18.00, is likewise achieved in a single forward movement, by moving both hands separately to their corresponding target (4). During the last approximation from 17.59 to 18.00, the day/night display switches from sun to moon, and in the same way it would be possible to switch to midnight in a generally comprehensible and internally followable manner. This third leap to 0.00, however, would have no point, since it is achieved with only a single push of the button and the "tomorrow leap" or "next day leap" as follows.

FIG. 6*c,* as with all the following examples, takes as its starting point the time of 8.10 (1) on Wednesday (W=Wednesday), the $20^{th}$. The target is tomorrow, Thursday the $21^{st}$ (T=Thursday 21), 0.00 (5). Again the two hands move separately, the first revolution talking place for the day, and the hour hand being moved at an angle of 45° over the midday limit of 12.00 towards 18.00; when the evening time limit (3) of 18.00 is passed, the day display switches from sun to moon. In this 45° angle, that the user can remember easily as the leap to tomorrow, the hour hand first reaches 12.00 (4), with the result that this angle of 45° for a fraction of a second stands as a fixed angle, easily remembered, before tomorrow. If the hour hand switches to 0.00, the day display simultaneously switches from Wednesday $20^{th}$ to Thursday $21^{st}$ (T21) A leap to the next day starting from 0.00 could be shown graphically in the same way as here, in two revolutions at an angle of 45°, with again the sun appearing at 6.00 and the moon at 1800.

FIG. 6*d* shows a leap from Wednesday, $20^{th}$ (1) to Monday, $25^{th}$ (5). The characteristic feature of a leap to Monday is the right angle in which the hour and minute hands move towards the target. During this movement, the date display moves consecutively from Wednesday $20^{th}$ to Monday $25^{th}$, with the date only changing from Sunday to Monday when the minute hand has closed the 45° angle to 0 (5). In a leap to the following Monday, the hour hand would first leap forward and represent the 45° angle to the minute hand and then the rotation towards the target could begin.

FIG. 6*e* shows the leap to the beginning of the next month, whereby the characteristic feature of the monthly leap is the 180° angle. If the month key is repeatedly pressed, the hands always move in the same 180° position, like a propeller, and the target month appears in the date display, with the result that one has a clear orientation for the leap with an analog display.

FIGS. 6*b–e* show forward movements to a target time in analog manner that can be followed internally. If the display automatically returns to the present time or a very close appointment time, the hands and the date display move backwards in a similar manner to the forward movement described here.

The realisation example in FIG. 7 is strongly based on what we see in nature.

If the whole-day dial refers to an appointment display that can be entered very quickly, the question does not arise of whether the change of sun and moon at 6 o'clock in the morning and 18.00 in the evening can be followed, since the time display for appointments does not move.

However, it is different if the whole-day display of a clock is used as main display and the transition from day to night and night to day is to be experienced. In addition, in certain cases it would be appropriate to delay this process a little, if for instance the second hand cannot be seen from a distance, although it can be seen whether the sun is getting smaller, i.e. if it is sunset, or vice versa.

This embodiment is intended to evoke in particular a strong emotional experience and show very clearly, through the movement of the stars and the rising of the moon, that night is falling. For countries in which almost 30% of younger people cannot read the ambiguous half-day dial, this would provide the opportunity of permitting a completely new access to the analog "12-hour dial", if it is understood that a day consists of 12 night-time and 12 daytime hours.

FIG. 7*a* shows a wristwatch with dial 1 and a cutout 2, through which the moon can be seen, the part of a sun-moon disc 4. The slow turning of this disc permits the experiencing of the switch from night to day or day to night.

FIG. 7*b* shows the change from sun to moon in gradual transition, by means of a simulation of sunset and sunrise.

FIG. 7*b* is a dial 1 with a cut out 2, revealing the image of the sun 3 at a lower level. Between dial 1 and the level 2 underneath on which the sun is shown, a star/moon eccentric disc 4 can be moved, which can be turned around the main axis 5 anticlockwise as the sun sets, with the result that the plate when moved slowly anticlockwise shows the sun slowly becoming darkened from bottom left upwards, and the start of sunset 6. At 7, a number of stars are already appearing. Phase 8, as can be seen on the star/moon disc, is deliberately a longer stage since on the one hand the movement of the stars is particularly attractive to watch, while on the other hand this permits the display of specific constellations that can be made by the manufacturer or watchmaker with the desired zodiac sign or a number of zodiac signs, depending on the watch/clock, which would be interesting for sales. Phase 9 begins the final phase 10 with the moon.

Sunrise is shown by the disc turning clockwise.

FIG. 7*c* shows a somewhat different solution to the same idea, namely presenting sunset and sunrise as naturally as possible. While in FIG. 7*b* the sun tends to get darker from bottom left, FIG. 7*c* shows a somewhat simpler, less dynamic sunrise and sunset, but which is more realistic in the course of the horizon. In main dial 1, as in FIG. 7*b* there is an opening too, revealing the sun presented on the layer below, 3. A moon disc 4 can turn on axis 5, with cut-out 6 on this disc permitting the axis of the main dial hands to penetrate. This moon disc lies between the main dial 1 and the level 3 below on which the sun is shown. This moon disc can only be swivelled from position 7 shown here to position 8 by means of an anticlockwise turn around axis 5, as a result of which the sun becomes darker relatively accurately from bottom to top, as shown in positions 9 to 13. The advantage compared with solution 7*b* is that this transition using a horizontal horizon is less dramatic but relatively natural.

All solutions have the advantage over the "leaping mood" or "leaping sun" that the transition can be drawn out over a number of seconds without there being any doubt of whether it is now becoming day or night.

What is claimed is:

1. Dial with an analog 12-hour display showing a 24-hour day ambiguously using an hour and a minute hand, and an additional display that serves to specify the time shown with the hour and minute hands and including two symbols each standing for the period of time from 6 o'clock in the morning to 6 o'clock in the evening and from 6 o'clock in the evening to 6 o'clock in the morning respectively, characterized by the combination of the following features:

in the additional display, the two symbols are visible separately from each other, and the change from the night symbol to the day symbol at 6 o'clock in the morning and from the day symbol to the night symbol at 6 o'clock in the evening is either sudden and precise to the second or the symbol shown in the additional display, at a time close before an immediately pending change of symbol, is visually emphasized through movement in the form of shaking or by flashing such that there is always unambiguity with respect to the time.

2. Dial according to claim 1 characterized by the fact that the day symbol is a stylized sun on a light background and the night symbol a stylized moon on a dark background.

3. Dial according to claim 1 characterized by the fact that sequences of images are shown in the additional display illustrating the transition from the day to the night symbol and vice versa.

4. Dial according to claim 2 characterized by the fact that sequences of images are shown in the additional display illustrating the transition from the day to the night symbol and vice versa.

5. Dial according to claim 1 characterized by the fact that the additional display in the right upper quadrant of the dial is located between 1 o'clock and 2 o'clock.

6. Dial according to claim 2 characterized by the fact that the additional display in the right upper quadrant of the dial is located between 1 o'clock and 2 o'clock.

7. Dial according to claim 3 characterized by the fact that the additional display in the right upper quadrant of the dial is located between 1 o'clock and 2 o'clock.

8. Dial according to claim 1 characterized by the fact that input means are provided for inputting date-related times in the future, triggering the following functions through separate activation:

from the present time, the minute and hour hands move to the 12 o'clock position, from the present time, the minute and hour hands move to the 6 o'clock position, from the present time, the minute and hour hands move to the zero hour position of the next day, from the present time, the minute and hour hands move to the position of the next Monday, from the present time, the minute and hour hands move to the zero hour position of the next month, the manner of the movement of the hands move depending on the input means used in such a way that if the 12 o'clock or 6 o'clock position of the current day is entered, the hour hand and minute hand simultaneously and independently of each other move to the position for the time entered, if the zero hour position of the next day of a point of time is entered, the hour and minute hands form a first specified angle and in this position move synchronously to the entered time, if the zero hour position of the next Monday is entered, the hour and minute hands form a second fixed angle and in this position move synchronously to the time entered, if the zero hour position of the start of the next month is entered, the hour and minute hands form a third fixed angle and in this position move synchronously to the time entered.

9. Dial according to claim 2 characterized by the fact that input means are provided for inputting date-related times in the future, triggering the following functions through separate activation:

from the present time, the minute and hour hands move to the 12 o'clock position, from the present time, the minute and hour hands move to the 6 o'clock position, from the present time, the minute and hour hands move to the zero hour position of the next day, from the present time, the minute and hour hands move to the position of the next Monday, from the present time, the minute and hour hands move to the zero hour position of the next month, the manner of the movement of the hands move depending on the input means used in such a way that if the 12 o'clock or 6 o'clock position of the current day is entered, the hour hand and minute hand simultaneously and independently of each other move to the position for the time entered, if the zero hour position of the next day of a point of time is entered, the hour and minute hands form a first specified angle and in this position move synchronously to the entered time, if the zero hour position of the next Monday is entered, the hour and minute hands form a second fixed angle and in this position move synchronously to the time entered, if the zero hour position of the start of the next month is entered, the hour and minute hands form a third fixed angle and in this position move synchronously to the time entered.

10. Dial according to claim 3 characterized by the fact that input means are provided for inputting date-related times in the future, triggering the following functions through separate activation:

from the present time, the minute and hour hands move to the 12 o'clock position, from the present time, the minute and hour hands move to the 6 o'clock position, from the present time, the minute and hour hands move to the zero hour position of the next day, from the present time, the minute and hour hands move to the position of the next Monday, from the present time, the minute and hour hands move to the zero hour position of the next month, the manner of the movement of the hands move depending on the input means used in such a way that if the 12 o'clock or 6 o'clock position of the current day is entered, the hour hand and minute hand simultaneously and independently of each other move to the position for the time entered, if the zero hour position of the next day of a point of time is entered, the hour and minute hands form a first specified angle and in this position move synchronously to the entered time, if the zero hour position of the next Monday is entered, the hour and minute hands form a second fixed angle and in this position move synchronously to the time entered, if the zero hour position of the start of the next month is entered, the hour and minute hands form a third fixed angle and in this position move synchronously to the time entered.

11. Dial according to claim 5 characterized by the fact that input means are provided for inputting date-related times in the future, triggering the following functions through separate activation:

from the present time, the minute and hour hands move to the 12 o'clock position, from the present time, the minute and hour hands move to the 6 o'clock position, from the present time, the minute and hour hands move to the zero hour position of the next day, from the present time, the minute and hour hands move to the position of the next Monday, from the present time, the minute and hour hands move to the zero hour position of the next month, the manner of the movement of the hands move depending on the input means used in such a way that if the 12 o'clock or 6 o'clock position of the current day is entered, the hour hand and minute hand simultaneously and independently of each other move to the position for the time entered, if the zero hour position of the next day of a point of time is entered, the hour and minute hands form a first specified angle and in this position move synchronously to the entered time, if the zero hour position of the next Monday is entered, the hour and minute hands form a second fixed angle and in this position move synchronously to the time entered, if the zero hour position of the start of the next month is entered, the hour and minute hands form a third fixed angle and in this position move synchronously to the time entered.

12. Dial according to the preamble to claim 1 with a data display characterized by the fact that input means are provided for inputting date-related times in the future, triggering the following functions through separate activation:

from the present time, the minute and hour hands move to the 12 o'clock position, from the present time, the minute and hour hands move to the 6 o'clock position, from the present time, the minute and hour hands move to the zero hour position of the next day, from the present time, the minute and hour hands move to the position of the next Monday, from the present time, the minute and hour hands move to the zero hour position of the next month, the manner of the movement of the hands move depending on the input means used in such a way that if the 12 o'clock or 6 o'clock position of the current day is entered, the hour hand and minute hand simultaneously and independently of each other move to the position for the time entered, if the zero hour position of the next day of a point of time is entered, the hour and minute hands form a first specified angle and in this position move synchronously to the entered time, if the zero hour position of the next Monday is entered, the hour and minute hands form a second fixed angle and in this position move synchronously to the time entered, if the zero hour position of the start of the next month is entered, the hour and minute hands form a third fixed angle and in this position move synchronously to the time entered.

* * * * *

UNITED STATES PATENT AND TRADEMARK OFFICE

CERTIFICATE OF CORRECTION

PATENT NO. : 6,359,839 B1 
DATED : March 19, 2002
INVENTOR(S) : Schenk et al.

It is certified that error appears in the above-identified patent and that said Letters Patent is hereby corrected as shown below:

Title page,
Item [57], ABSTRACT,
Line 1, please delete "A" and insert therefor -- The invention relates to a --.

Column 2,
Line 3, please delete "am." and insert therefor -- a.m. --.
Line 3, after "are present" please insert -- . --.

Column 3,
Line 60, please delete "unuambigiity" and insert therefor -- unambiguity --.

Column 4,
Line 8, after "relatively good." please begin a new paragraph.
Line 11, after "3*d*2)" please insert -- , --.
Line 16, please delete "fill" and insert therefor -- full --.
Line 28, after "half" please insert -- . --.
Lines 59-67, please un-indent these lines.
Line 60, please delete "," and insert therefor -- . --.

Column 5,
Lines 1-4, please un-indent these lines.
Line 13, please delete "mower" and insert therefor -- manner --.

Column 6,
Lines 32-35, please indent these lines.

Column 7,
Line 41, please delete "arc" and insert therefor -- are --.
Line 65, please delete "Clock" and insert therefor -- clock --.

UNITED STATES PATENT AND TRADEMARK OFFICE

CERTIFICATE OF CORRECTION

PATENT NO. : 6,359,839 B1 
DATED : March 19, 2002
INVENTOR(S) : Schenk et al.

It is certified that error appears in the above-identified patent and that said Letters Patent is hereby corrected as shown below:

Column 9,
Line 51, please delete “mood” and insert therefor -- moon --.

Signed and Sealed this

First Day of October, 2002

*Attest:*

*Attesting Officer*

JAMES E. ROGAN
*Director of the United States Patent and Trademark Office*